US007647903B2

(12) United States Patent
Fujii et al.

(10) Patent No.: US 7,647,903 B2
(45) **Date of Patent: *Jan. 19, 2010**

(54) VARIABLE VALVE LIFT DEVICE OF INTERNAL COMBUSTION ENGINE

(75) Inventors: Noriaki Fujii, Wako (JP); Akiyuki Yonekawa, Wako (JP); Tomoya Fujimoto, Wako (JP); Katsunori Nakamura, Wako (JP); Keiko Yoshida, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 573 days.

This patent is subject to a terminal disclaimer.

(21) Appl. No.: 10/584,499

(22) PCT Filed: Dec. 21, 2004

(86) PCT No.: PCT/JP2004/019082

§ 371 (c)(1),
(2), (4) Date: Jun. 22, 2006

(87) PCT Pub. No.: WO2005/061864

PCT Pub. Date: Jul. 7, 2005

(65) Prior Publication Data

US 2009/0013946 A1 Jan. 15, 2009

(30) Foreign Application Priority Data

Dec. 24, 2003 (JP) ..... 2003-426069
Jan. 30, 2004 (JP) ..... 2004-023952

(51) Int. Cl.
*F11L 1/34* (2006.01)

(52) U.S. Cl. ..... 123/90.16; 123/90.39; 123/90.44; 74/559; 74/569

(58) Field of Classification Search ..... 123/90.15, 123/90.16, 90.17, 90.18, 90.27, 90.31, 345, 123/346, 347, 348, 90.2, 90.39, 90.44; 74/559, 74/567, 569; 29/888.01, 888.2
See application file for complete search history.

(56) References Cited

FOREIGN PATENT DOCUMENTS

| | | |
|---|---|---|
| EP | 1 533486 A1 | 5/2005 |
| EP | 1 628 007 A1 | 2/2006 |
| JP | 8-74534 | 3/1996 |
| JP | 2004-36560 | 2/2004 |
| JP | 2004-353599 | 12/2004 |

OTHER PUBLICATIONS

Supplementary European Search Report dated Nov. 6, 2008.

*Primary Examiner*—Ching Chang
(74) *Attorney, Agent, or Firm*—Kratz, Quintos & Hanson, LLP

(57) ABSTRACT

A variable valve lift device of an internal combustion engine having a first link arm rotatably supported at a fixed position of an engine body rotatably connected to a rocker arm, and a movable support shaft rotatably supporting one end portion of a second link arm of which an other end portion rotatably connected to the rocker arm is connected to a crank member formed in a crank shape having crank webs sandwiching the second link arm from opposite sides and a connecting part integrally joining both the crank webs at a position where interference with the second link arm is avoided. The crank member is rotationally driven with a drive device and an amount of lift of an engine valve is continuously changed, in addition to which, torsional rigidity of the crank member is ensured while ensuring assembly workability of the second link arm to the crank member, and reduction in size is made possible.

11 Claims, 10 Drawing Sheets

VARIABLE VALVE LIFT DEVICE OF INTERNAL COMBUSTION ENGINE

TECHNICAL FIELD

The present invention relates to a variable valve lift device of an internal combustion engine which continuously changes an amount of lift of an engine valve that is an intake valve or an exhaust valve.

BACKGROUND ART

A valve operating system in which one end of a push rod is fitted to one end of a rocker arm having a valve abutment part abutting to an engine valve at the other end side and a link mechanism is provided between the other end of the push rod and a valve operating cam in order to continuously change the amount of lift of the engine valve is already known by Patent Document 1.

However, in the valve operating mechanism disclosed in the above-described Patent Document 1, it is necessary to ensure a comparatively large space to dispose a link mechanism and the push rod therein, between the valve operating cam and the rocker arm, and therefore, the valve operating system becomes large in size. In addition, a driving force from the valve operating cam is transmitted to the rocker arm via the link mechanism and the push rod, and therefore, it is difficult to say follow-up ability of the rocker arm to the valve operating cam, namely, follow-up ability of opening and closing operation of the engine valve is excellent.

Thus, the applicant already proposes a valve operating system of the internal combustion engine in which one end portions of a first and second link arm are rotatably connected to a rocker arm, the other end portion of the first link arm is rotatably supported at an engine body, and the other end portion of the second link arm is displaced by drive means in Patent Document 2. According to the valve operating system, it is possible to make the valve operating system compact and it is also possible to ensure excellent follow-up ability to the valve operating cam by directly transmitting the power from the valve operating cam to the rocker arm.

Patent Document 1

Japanese Patent Application Laid-open No. 8-74534

Patent Document 2

Japanese Patent Application Laid-open No. 2004-36560

DISCLOSURE OF THE INVENTION

Problems to be Solved by the Invention

Incidentally, in the valve operating system of the above-described Patent Document 2, a crank member includes a pair of crank webs which sandwich the second link arm from opposite sides, and both the crank webs are connected by a movable support shaft which supports the other end portion of the second link arm. Whereas assembly workability of the second link arm to the crank member is considered, it is necessary to form at least one of the crank webs and the movable support shaft to be separate members and couple the crank web, which is the separate member from the movable support shaft, to the other end of the movable support shaft after mounting one end of the movable support shaft to the other crank member.

Whereas in the variable valve device, since a torsion force acts on the movable support shaft by the driving torque applied to the crank web, sufficient torsional rigidity is required at a joining portion of the movable support shaft and the crank web. In order to enhance such torsional rigidity, it is considered to integrally form the movable support shaft and the crank web by forging or the like, but when the second link arm is to be assembled to the crank member with the movable support shaft and the crank web integrated, a connection hole provided in the second link arm to insert the movable support shaft therethrough has to be in the construction split in two halves as a large end portion of a connecting rod, and increase in the size of the second link arm cannot be avoided. Namely, it is extremely difficult to ensure torsional rigidity at the joining portion of the movable support shaft and the crank web while avoiding increase in size of the variable valve lift device and ensuring assembly workability of the second link arm to the crank member.

The present invention is made in view of the above circumstances, and has its object to provide a variable valve lift device of an internal combustion engine capable of ensuring torsional rigidity of a crank member while securing assembly workability of the second link arm to the crank member and being made compact.

Means for Solving the Problems

In order to accomplish the above-described object, in accordance with a first aspect of the present invention, there is proposed a variable valve lift device characterized by including a rocker arm linked and connected to an engine valve having a cam abutment part abutting to a valve operating cam, a first link arm with one end portion rotatably connected to the rocker arm and the other end portion rotatably supported at a fixed position of an engine body via a fixed support shaft, a second link arm with one end portion rotatably connected to the rocker arm, a movable support shaft which rotatably supports the other end portion of the second link arm, a crank member connected to the movable support shaft allowing the movable support shaft to perform angular displacement around an axis parallel with its axis and rotatably supported at the engine body, and drive means connected to the crank member to make the movable support shaft perform angular displacement, wherein the crank member is formed in a crank shape, having crank webs sandwiching the second link arm from opposite sides, and a connecting part integrally joining both the crank webs at a position where interference with the second link arm is avoided, and the movable support shaft is connected to the crank member to connect both the crank webs.

In accordance with a second aspect of the present invention, in addition to the first aspect, there is provided a variable valve lift device of an internal combustion engine, wherein a stopper pin parallel with an axis of rotation of the crank member is provided to protrude at the crank web to restrain a rotation range of the crank member by engagement with the engine body side.

In accordance with a third aspect of the present invention, in addition to the first or second aspect, there is proposed a variable valve lift device of an internal combustion engine, wherein the crank member is supported at the engine body at opposite sides of the rocker arm.

In accordance with a fourth aspect of the present invention, in addition to the first aspect, there is proposed a variable valve lift device of an internal combustion engine, wherein the single crank member common to a plurality of cylinders arranged in line is supported at the engine body.

In accordance with a fifth aspect of the present invention, in addition to the first aspect, there is proposed a variable valve lift device of an internal combustion engine, wherein the crank member has a journal part perpendicularly connecting to an outer face of the crank web, and the journal part is rotatably supported between an upper holder forming a part of a cam holder rotatably supporting a camshaft provided with the valve operating cam and joined to the cylinder head of the engine body, and a lower holder joined to the upper holder from below.

In accordance with a sixth aspect of the present invention, in addition to the fifth aspect, there is proposed a variable valve lift device of an internal combustion engine, wherein lower holder which is a separate body from the cylinder head is fastened to the upper holder.

In accordance with a seventh aspect of the present invention, in addition to the fifth or sixth aspect, there is proposed a variable valve lift device of an internal combustion engine, wherein a roller bearing capable of being split into halves is interposed between the upper and lower holders and the journal part.

In accordance with an eighth aspect of the present invention, in addition to the fifth aspect, there is proposed a variable valve lift device of an internal combustion engine, wherein a crank member support boss part protruded to the crank web side is formed in the upper and lower holders joined to each other, and the journal part penetrating through the crank member support boss part is rotatably supported between the upper and lower holders.

In accordance with a ninth aspect of the present invention, in addition to the eighth aspect, there is proposed a variable valve lift device of an internal combustion engine, wherein a camshaft support boss part protruded to the rocker arm side is formed in the upper holder and a cap joined to the upper holder from above, and the camshaft having the valve operating cam penetrates through the camshaft support boss part and is rotatably supported between the upper holder and the cap.

In accordance with a tenth aspect of the present invention, in addition to the ninth aspect, there is proposed a variable valve lift device, wherein a rib connecting the crank member support boss part and the camshaft support boss part is provided to protrude at the upper holder.

In accordance with an eleventh aspect of the present invention, in addition to the first aspect, there is proposed a variable valve lift device, wherein the crank member is disposed between the engine valve and a plug cylinder provided at a cylinder head so that an outer face of the connecting part is opposed to the plug cylinder, and a relief groove for avoiding interference with the plug cylinder is formed on the outer face of the connecting part.

EFFECT OF THE INVENTION

In accordance with the first aspect of the invention, it is possible to continuously change the amount of lift of the engine valve by driving the control shaft to make angular displacement and continuously displacing the movable support shaft, and the one end portions of the first and second link arms are directly connected to the rocker arm to be rotatable, the valve operating system can be made compact by reducing the space in which both the link arms are disposed, and the power from the valve operating cam is directly transmitted to the cam abutment part of the intake side rocker arm, therefore making it possible to ensure excellent follow-up ability to the valve operating cam. In addition, since the crank webs sandwiching the second link arm from opposite sides are integrally connected with the connecting part, the torsion strength burden of the movable support shaft can be made small even if the torque required for rotating the crank member is large, and assembly is facilitated by making the movable support shaft a separate body from the crank member to be able to form the movable support shaft to be inserted by press-fitting or the like in the state in which the movable support shaft insertion parts of a pair of crank webs and the second link arm are aligned. Further, the connecting part of the crank member does not interferer with the second link arm, and therefore, the crank member and the second link arm do not become large in size.

In accordance with the second aspect of the invention, the structure to restrain the rotation range of the crank member can be constructed to be compact.

In accordance with the third aspect of the invention, the crank member is supported at the engine body at opposite sides of the rocker arm, and therefore, the support rigidity of the crank member is enhanced by support at the opposite sides, thus making it possible to precisely perform variable lift amount control of the engine valve.

In accordance with the fourth aspect of the invention, the increase in the number of components is avoided and the internal combustion engine can be made compact by using the single crank member common to a plurality of cylinders.

In accordance with the fifth aspect of the invention, assembly workability of the crank member to the engine body can be enhanced.

In accordance with the sixth aspect of the invention, the degree of freedom of the design of the cylinder head in supporting the crank member can be increased.

In accordance with the seventh aspect of the invention, the assembly workability of the crank member can be enhanced while reducing the friction loss at the support part of the crank member.

In accordance with the eighth aspect of the invention, support rigidity of the crank member can be further enhanced.

In accordance with the ninth aspect of the invention, support rigidity of the camshaft can be enhanced while suppressing the number of components for supporting the camshaft to minimum.

In accordance with the tenth aspect of the invention, support rigidity of the crank member and the camshaft can be further enhanced.

In accordance with the eleventh aspect of the invention, it is made possible to dispose the plug cylinder closer to the valve operating system side and to make the internal combustion engine compact.

EXPLANATION OF NUMERALS AND SYMBOLS

Figure 1:
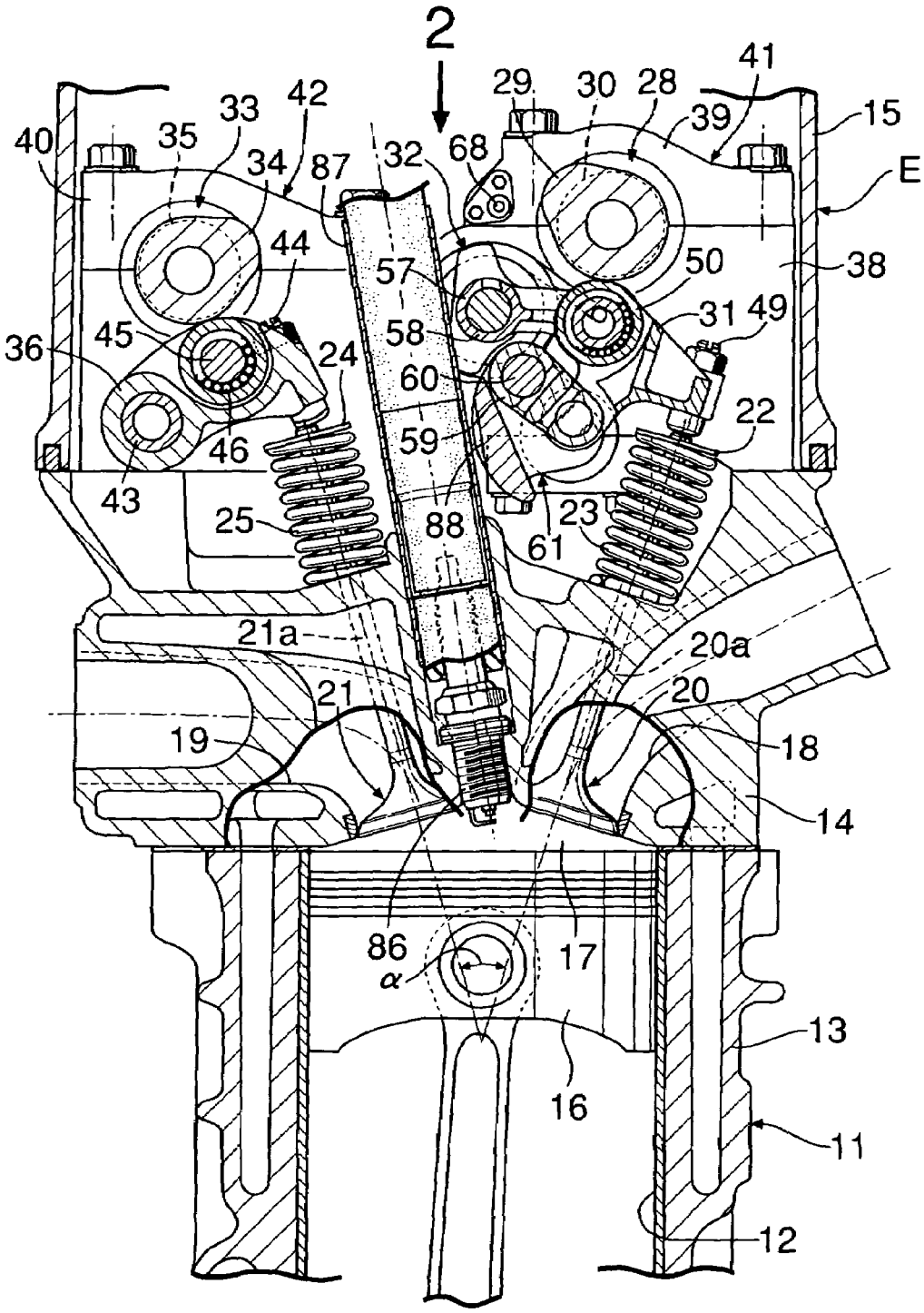
FIG. 1 is a partially longitudinal sectional view of an internal combustion engine and a sectional view taken along the line 1 to 1 in FIG. 2.

11 . . . engine body
14 . . . cylinder head
20 . . . intake valve as engine valve
29 . . . valve operating cam
30 . . . camshaft
31 . . . rocker arm
32 . . . variable valve lift device
38 . . . upper holder
39 . . . cap
50 . . . roller as cam abutment part
57 . . . intake side rocker shaft as fixed support shaft
58 . . . first link arm
59 . . . second link arm
60 . . . movable support shaft
61 . . . crank member
61*a* . . . crank web
61*b* . . . journal part
61*c* . . . connecting part
62 . . . actuator motor as drive means
77 . . . lower holder
79 . . . roller bearing
80 . . . crank member support boss part
81 . . . camshaft support boss part
82 . . . rib
87 . . . plug cylinder
88 . . . relief groove
105 . . . stopper pin

BEST MODE FOR CARRYING OUT THE INVENTION

Hereinafter, an embodiment of the present invention will be explained based on one embodiment of the present invention shown in the attached drawings.

Embodiment 1

FIG. 1 to FIG. 10 show one embodiment of the present invention.

First, in FIG. 1, an engine body 11 of an in-line multi-cylinder internal combustion engine E includes a cylinder block 13 provided with cylinder bores 12 . . . inside, a cylinder head 14 joined to a top face of the cylinder block 13 and a head cover 15 joined to a top face of the cylinder head 14. Pistons 16 . . . are slidably fitted into the respective cylinder bores 12 . . . , and combustion chambers 17 . . . to which top portions of the respective pistons 16 . . . are faced are formed between the cylinder block 13 and the cylinder head 14.

The cylinder head 14 is provided with intake ports 18 . . . and exhaust ports 19 . . . communicable with the respective combustion chambers 17 . . . . Each of the intake ports 18 . . . is opened and closed by intake valves 20 . . . which are a pair of engine valves, and each exhaust port 19 is opened and closed by a pair of exhaust valves 21 . . . . A valve spring 23 which biases each of the intake valves 20 . . . in a valve closing direction is provided between a spring sheet 22 provided at an upper end portion of a stem 20*a* included by the intake valve 20 and the cylinder head 14. A valve spring 25 which biases each of the exhaust valves 21 . . . in the valve closing direction is provided between a spring sheet 24 provided at an upper end portion of a stem 21*a* included by the exhaust valve 21 and the cylinder head 14.

An intake side valve operating system 28 for driving each of the intake valves 20 . . . to open and close each intake valve 20 is constructed in accordance with the present invention, and includes an intake side camshaft 30 having an intake side valve operating cam 29 for each cylinder, and an intake side rocker arm 31 which is driven by the intake side valve operating cam 29 to swing and commonly linked and connected to a pair of intake valves 20 . . . for each cylinder, and a variable valve lift device 32 for each cylinder, and an exhaust side valve operating system 33 for driving the exhaust valves 21 . . . to open and close includes an exhaust side camshaft 35 having an exhaust side valve operating cam 34 for each cylinder, and an exhaust side rocker arm 36 which is driven by the exhaust side valve operating cam 34 to swing and commonly linked and connected to a pair of exhaust valves 21 . . . for each cylinder.

Figure 2:
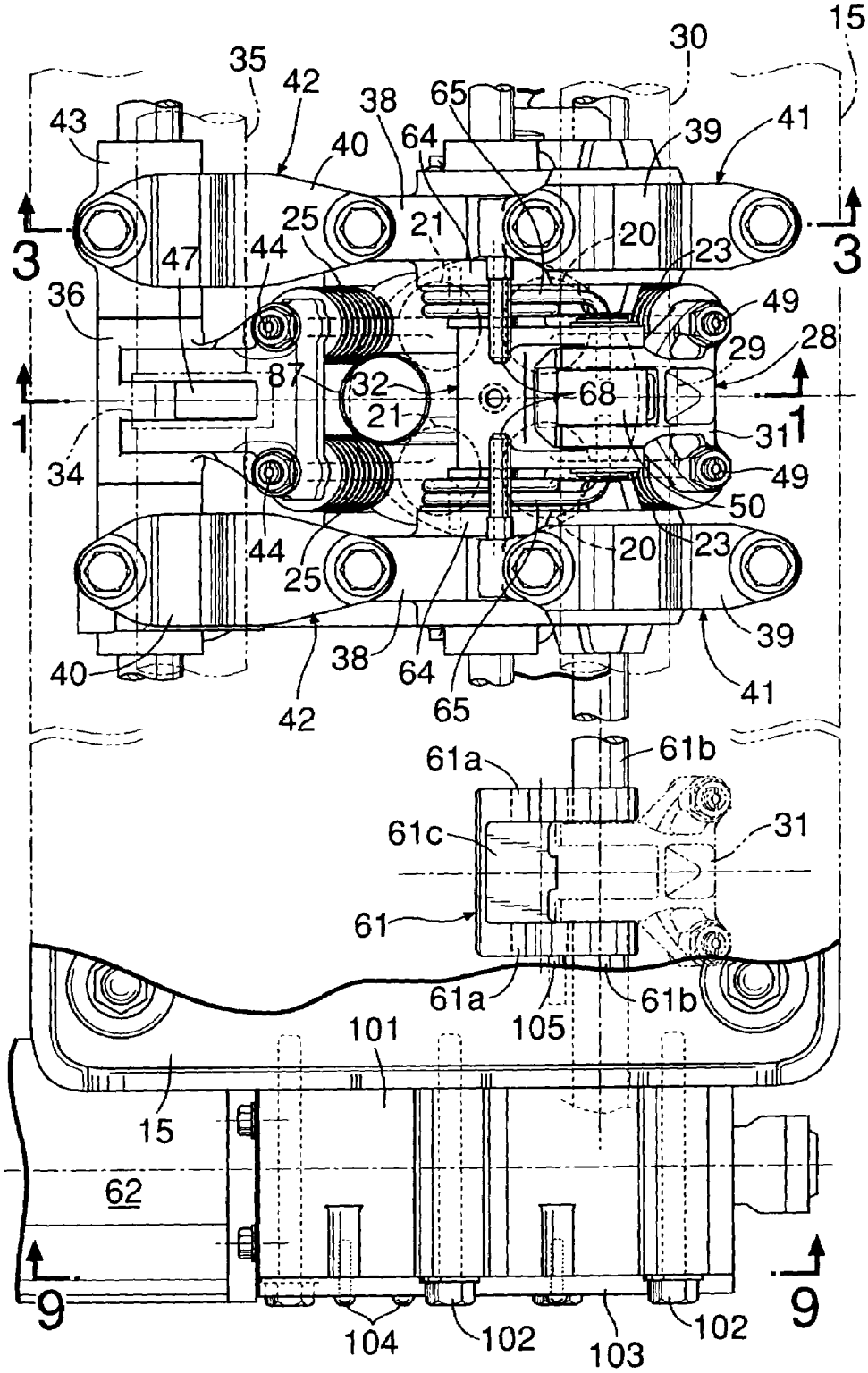
FIG. 2 is a sectional view taken along the line 2 to 2 in FIG. 1.
Figure 3:
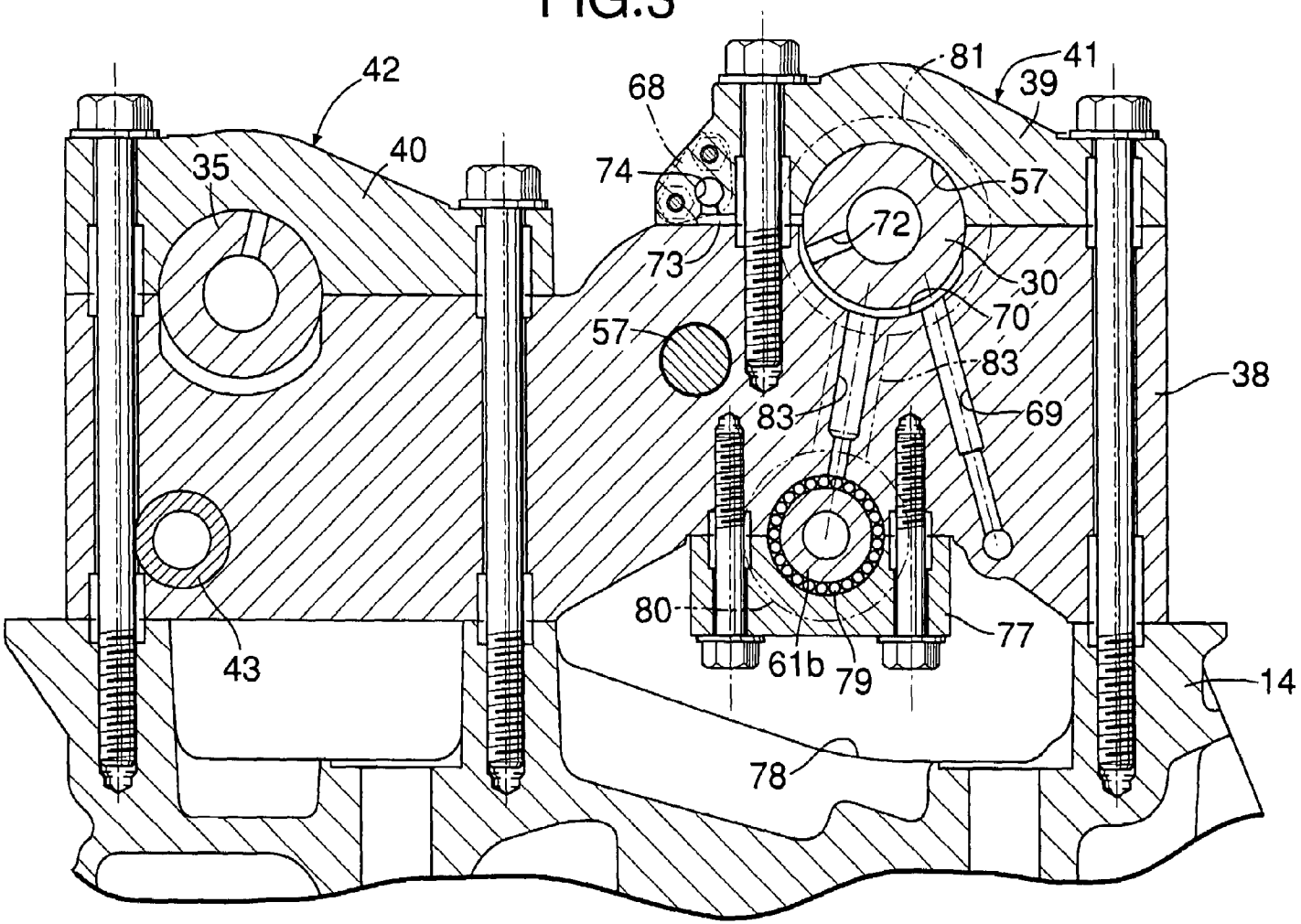
FIG. 3 is a sectional view taken along the line 3 to 3 in FIG. 2.

With reference to FIG. 2 and FIG. 3 in combination, upper holders 38 . . . are fastened to the cylinder head 14 so as to be disposed at opposite sides of each cylinder. Caps 39 . . . and 40 . . . which cooperate to construct intake side cam holders 41 . . . and exhaust side cam holders 42 . . . are fastened to the respective upper holders 38 . . . from above. Thus, the intake side camshaft 30 is rotatably supported between the upper holders 38 . . . and the cap 39 constituting the intake side cam holders 41 . . . , and the exhaust side camshaft 35 is rotatably supported between the upper holders 38 . . . and the caps 40 . . . which cooperate to construct the exhaust side cam holders 42

One end portion of the exhaust side rocker arm 36 is swingably supported by an exhaust side rocker shaft 43 having a parallel axis line with the exhaust side camshaft 35 and supported by the upper holder 38, and a pair of tappet screws 44 and 44 which abut to upper ends of the stems 21*a* . . . in a pair of exhaust valves 21 . . . are screwed into the other end portion of the exhaust side rocker arm 36 with their advance and retreat position adjustable. A shaft 45 which is parallel with the exhaust side rocker shaft 43 is provided in an intermediate portion of the exhaust side rocker arm 36, and a roller 47 in rolling contact with the exhaust side valve operating cam 34 is pivotally supported by the exhaust side rocker arm 36 with a roller bearing 46 interposed between the shaft 45 and the roller 47.

Such exhaust side valve operating system 33 is placed at the cylinder head 14 so that the swing support part of the exhaust side rocker arm 36, namely, the exhaust side rocker shaft 43 is disposed outside from the linking and connecting part of the exhaust side rocker arm 36 to the exhaust valves 21 . . . , namely, the tappet screws 44 . . . .

Figure 4:
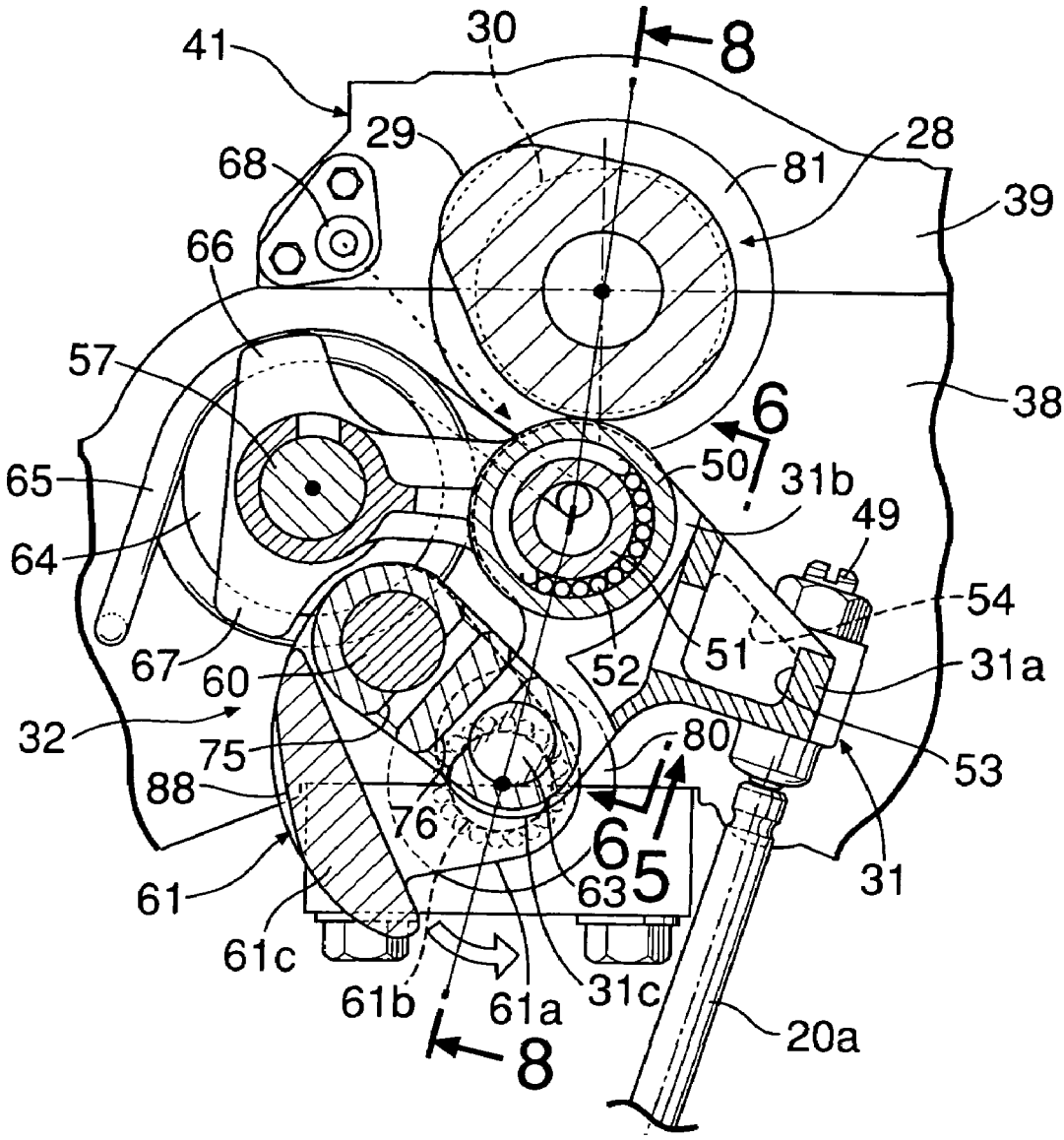
FIG. 4 is an enlarged view of an essential part in FIG. 1.
Figure 5:
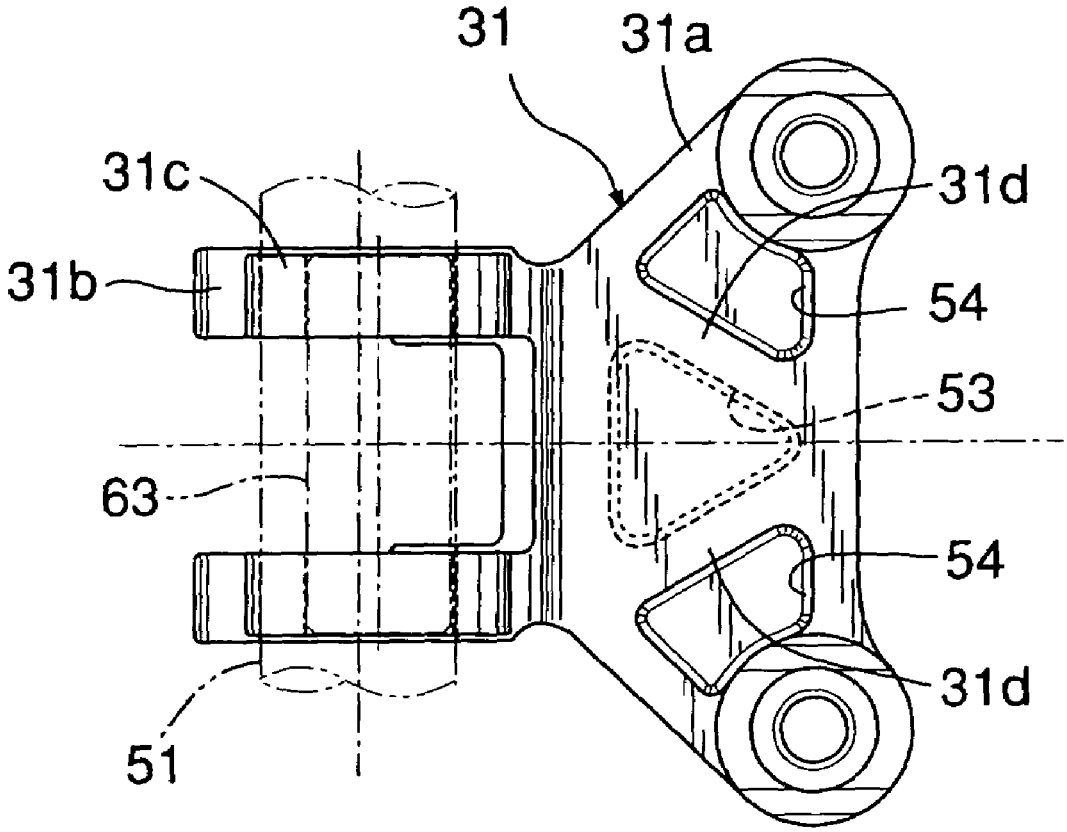
FIG. 5 is a bottom view of an intake side rocker arm seen in the direction of the arrow 5 in FIG. 4.

In FIG. 4 and FIG. 5, a valve connecting portion 31*a* into which tappet screws 49 and 49 abutting to upper ends of the stems 20*a* . . . in a pair of intake valves 20 . . . from above are screwed with their advance and retreat positions adjustable is provided at one end portion of the intake side rocker arm 31. A first support part 31*b* and a second support part 31*c* disposed under the first support part 31*b* are provided at the other end portion of the intake side rocker arm 31 to connect to each other, and the first and second support parts 31*b* and 31*c* are each formed into a substantially U-shape opened to an opposite side from the intake valves 20 . . . .

A roller 50 as a cam abutting part which is in rolling contact with the intake side valve operating cam 29 of the intake side camshaft 30 is pivotally supported at the first support part 31*b* of the intake side rocker arm 31 via a first connecting shaft 51 and a roller bearing 52, and the roller 50 is disposed to be caught in the first support part 31*b* which is in the substantially U-shape.

Figure 6:
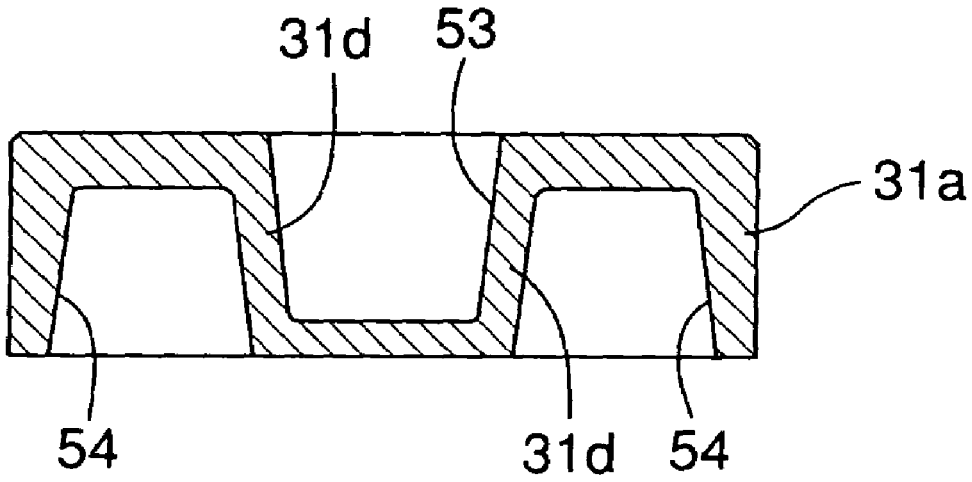
FIG. 6 is a sectional view taken along the line 6 to 6 in FIG. 4.

Referring also to FIG. 6, the intake side rocker arm 31 is formed by die forming by forging of light alloy, or the like. For example, a substantially triangular lightening part 53 is formed in a central part of the top face in the valve connecting part 31*a*, and a pair of lightening parts 54 and 54 are formed in opposite sides of a bottom face of the valve connecting part 31*a*, which is the face at the opposite side from the top face to be disposed to alternate with the lightening part 53.

Incidentally, the lightening parts 53, 54 and 54 are formed at the same time as the die forming of the intake side rocker arm 31, and while the draft angle of the upper lightening part 53 is in the direction to widen an opening area of the lightening part 53 toward the top face of the valve connecting part 31*a*, draft angles of the lower lightening parts 54 and 54 are in the direction to widen opening areas of the lightening parts 54 and 54 toward the bottom face of the valve connecting part 31*a*. Therefore, the inclination direction of the inner face of the lightening part 53 and the inclination directions of the inner faces of the lightening parts 54 and 54 are the same, and thicknesses of the wall parts 31*d* and 31*d* formed between the lightening parts 53 and 54; and 53 and 54 adjacent to each other are substantially uniform.

Figure 7:
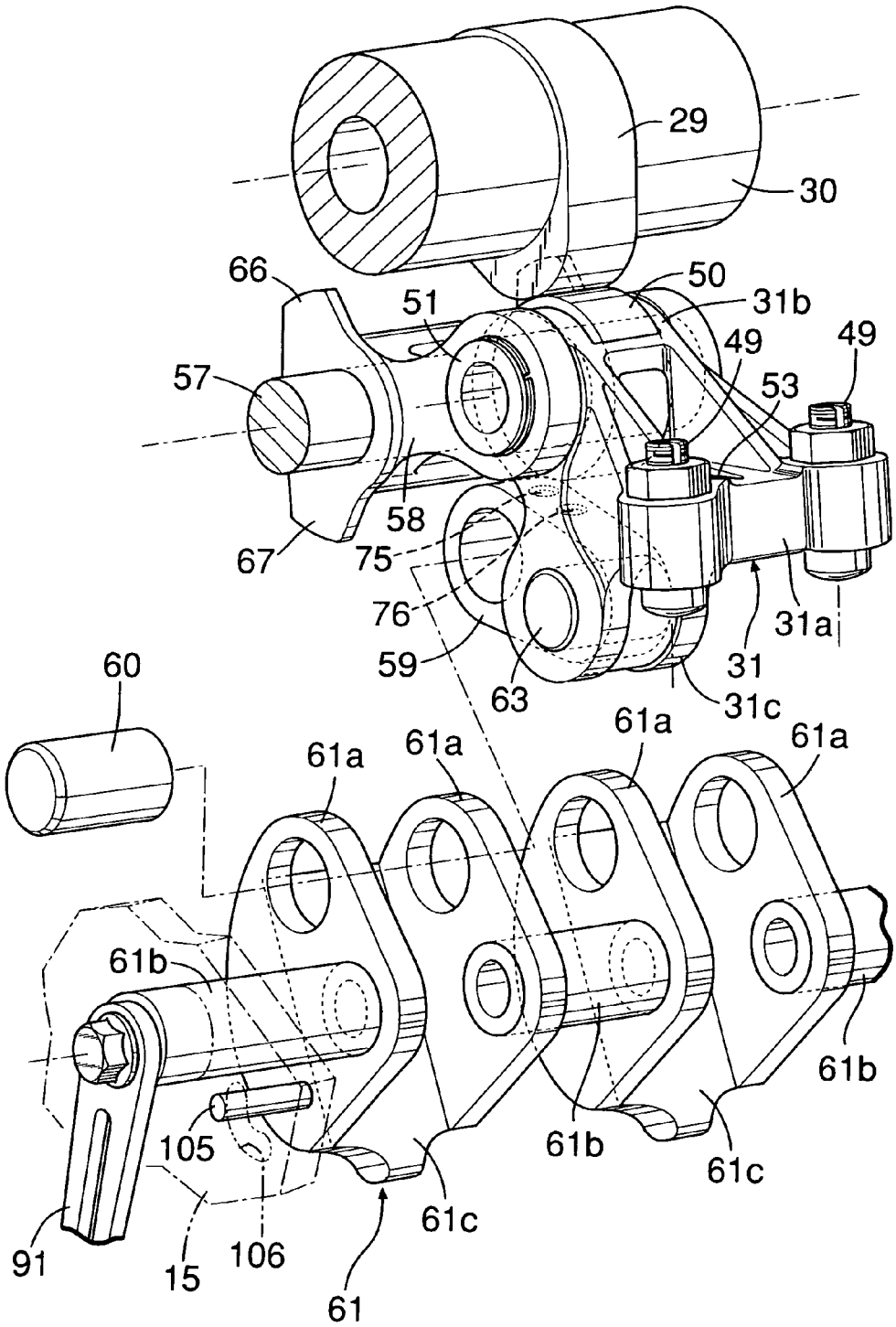
FIG. 7 is a perspective view of a variable lift mechanism.
Figure 8:
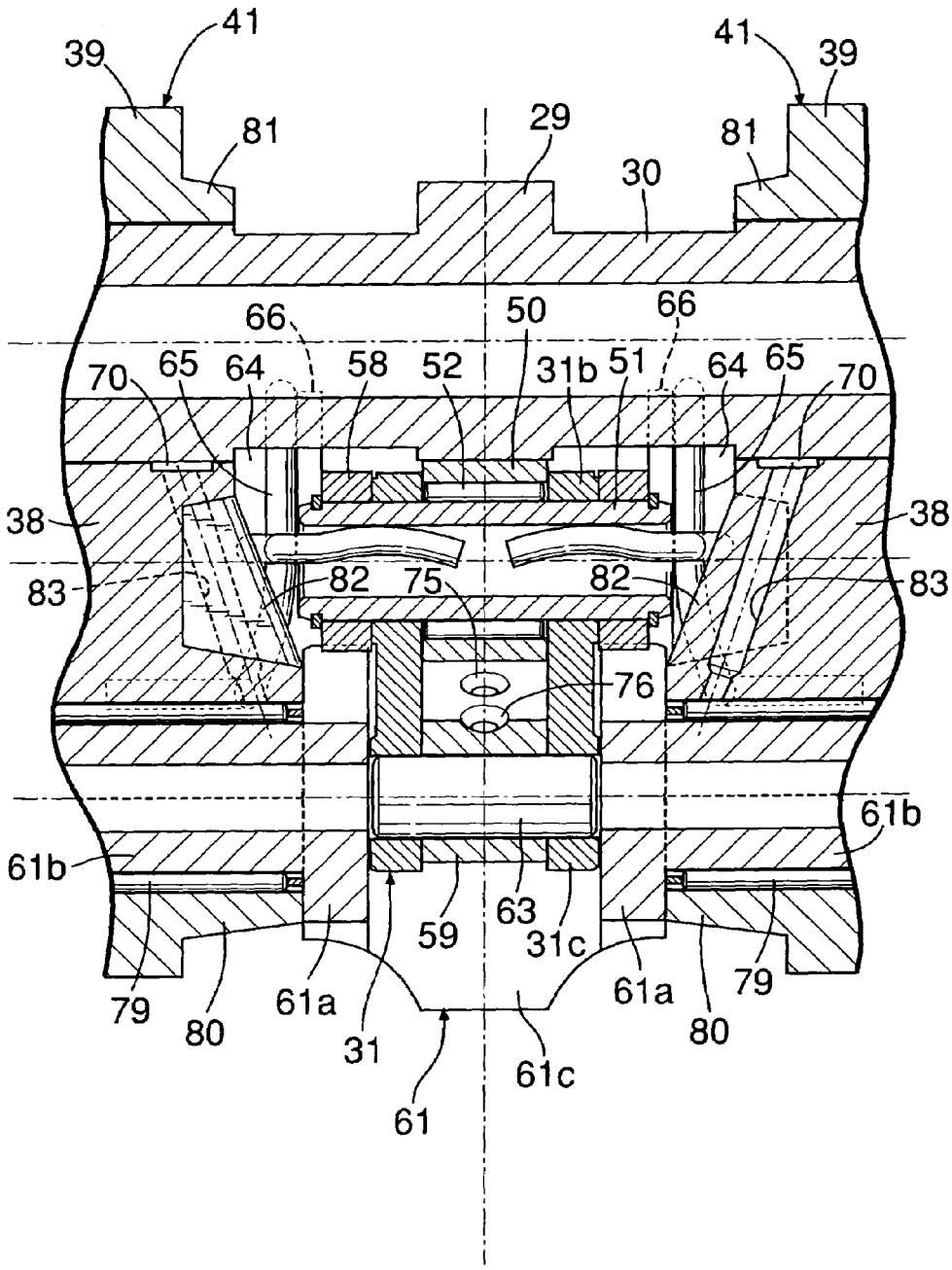
FIG. 8 is a sectional view taken along the line 8 to 8 in FIG. 4.

Referring also to FIG. 7 and FIG. 8, the variable valve lift device 32 includes a first link arm 58 with one end portion rotatably connected to the first support part 31*b* of the intake side rocker arm 31 and the other end portion rotatably supported at a fixed position of the engine body 11 via an intake side rocker shaft 57 as a fixed support shaft, a second link arm 59 with one end portion rotatably connected to the second support part 31*c* of the intake side rocker arm 31, a movable support shaft 60 rotatably supporting the other end portion of the second link arm 59, a crank member 61 connected to the movable support shaft 60 with the movable support shaft 60 capable of being allowed to make angular displacement around an axis parallel with the axis of the movable support shaft 60, and an actuator motor 62 as drive means, which is connected to the crank member 61 to allow the movable support shaft 60 to make angular displacement.

One end portion of the first link arm 58 is formed into a substantially U-shape to catch the first support part 31*b* of the intake side rocker arm 31 from opposite sides, and is rotatably connected to the first support part 31*b* via the first connecting shaft 51 which pivotally supports the roller 50 at the intake side rocker arm 31. The intake side rocker shaft 57, which rotatably supports the other end portion of the first link arm 58, is supported by the upper holders 38 . . . fastened to the cylinder head 14.

One end portion of the second link arm 59 disposed under the first link arm 58 is disposed to be caught by the second support part 31*c* of the intake side rocker arm 31, and is rotatably connected to the second support part 31*c* via a second connecting shaft 63.

Support bosses 64 and 64 are integrally provided to protrude at the upper holders 38 and 38 at opposite sides of the other end portion of the first link arm 58 so as to support the intake side rocker shaft 57, and with these support bosses 64 . . . , movement of the other end portion of the first link arm 58 in the direction along the axis of the intake side rocker shaft 57 at the other end portion of the first link arm 58 is restrained.

Incidentally, both the intake valves 20 . . . are biased in the valve closing direction by the valve springs 23 and the roller 50 of the intake side rocker arm 31 is in contact with the intake side valve operating cam 29 by the work of the valve springs 23 . . . when both the intake valves 20 . . . biased by spring in the valve closing direction is driven to the valve opening direction by the intake side rocker arm 31. In the valve closed state of the intake valves 20 . . . , the spring force of the valve springs 23 . . . does not act on the intake side rocker arm 31, the roller 50 separates from the intake side valve operating cam 29, and there is the possibility that the control precision of the amount of valve lift when the intake valves 20 . . . are slightly opened is reduced. Therefore, the intake side rocker arm 31 is biased in the direction to make the roller 50 abut to the intake side valve operating cam 29 by rocker arm biasing springs 65 . . . separate from the valve springs 23

The rocker arm biasing springs 65 . . . are coil-shaped torsion springs which surround the support bosses 64 . . . , and are provided between the engine body 11 and the intake side rocker arm 31. Namely, one ends of the rocker arm biasing springs 65 . . . are engaged in the support bosses . . . , and the other ends of the rocker arm biasing springs 65 . . . are inserted and engaged in the first connecting shaft 51 which is hollow and operated integrally with the intake side rocker arm 31.

The other end portion of the first link arm 58 is formed into a cylindrical shape so that an outer circumference is disposed at an inner side in the side view from an outer periphery of the rocker arm biasing springs 65 . . . which are wound in a coil shape, and a plurality of, for example, pairs of protruding parts 66 and 67 which inhibit the rocker arm biasing springs 65 . . . from falling to the first link arm 58 side are respectively provided to protrude, spaced in the circumferential direction at opposite ends in the axial direction at the other end portion of the first link arm 58. Accordingly, the fall of the rocker arm biasing springs 65 . . . is prevented while avoiding increase in size of the other end portion of the first link arm 58, and support rigidity of the other end portion of the first link arm 58 can be enhanced.

The protruded parts 66 and 67 are disposed to avoid the operation range of the second link arm 59, and therefore, the operation range of the second link arm 59 can be sufficiently secured irrespective of the protruded parts 66 and 67 . . . being provided at the other end portion of the first link arm 58.

Oil jets 68 . . . , which supply oil to the upper portion of the other end side of the intake side rocker arm 31, are attached to caps 39 . . . in the intake cam holders 41 . . . provided at the engine body 11.

Incidentally, a passage 69 which guides oil from an oil pump not shown is provided at one of a plurality of upper holders 38 . . . . Arc-shaped recessed parts 70 . . . are provided at the upper portion of each of the upper holders 38 . . . to oppose to the lower half part of the intake side camshaft 30, and the passage 69 communicates with one of the recessed parts 70 . . . . An oil passage 71 is coaxially provided in the intake side camshaft 30, and, at the portions corresponding to the respective intake side cam holders 41 . . . , the intake side camshaft 30 is provided with communication holes 72 . . . of which inner ends are allowed to communicate with the oil passage 71 are provided so that the outer ends of the communication holes 72 . . . open to the outer surface of the intake side camshaft 30. Lubricating oil is supplied between the respective intake side cam holders 41 . . . and the intake side camshaft 30 via the communication holes 72 . . . .

On the bottom surfaces of the caps 39 . . . , which construct the intake side cam holders 41 . . . with the upper holders 38 recessed parts 73 . . . , which form passages leading to the recessed parts 70 . . . in a space from upper surfaces of the upper holders 38 . . . , are provided, and the oil jets . . . 68 are mounted to the caps 39 . . . so as to communicate with the recessed parts 73 . . . and link to passages 74 . . . which are provided in the caps 39 . . . .

The oil jets 68 . . . are mounted to the caps 39 . . . of the intake cam holders 46 . . . provided at the engine body 11 to rotatably support the intake side camshaft 30 as above, and a sufficient amount of oil at sufficiently high pressure can be supplied from the oil jets 68 . . . by utilizing oil passage for lubricating spaces between the intake side camshaft 30 and the intake side cam holders 41 . . . .

Since oil is supplied from the oil jet 68 toward the upper first connecting shaft 51 of the first and second connecting shafts 51 and 63 which connect one end portions of the first and the second link arms 58 and 59 to the intake side rocker arm 31, the oil which lubricates a space between the first link arm 58 and the intake side rocker arm 31 flows down to the lower second link arm 59.

Oil introduction holes 75 and 76 with parts of the movable support shaft 60 and the second connecting shaft 63 faced to intermediate portions are provided in the second link arm 59 in a perpendicular direction to a straight line which connects axes of the movable support shaft 60 and the second connecting shaft 63, and one end of each of the oil introduction holes 75 and 76 is opened to the first connecting shaft 51 side. Accordingly, the oil which flows downward from the first link arm 58 is effectively guided between the second link arm 59, and the movable support shaft 60 and the second connecting shaft 63, and connecting parts of the intake side rocker arm 31 and the first and second link arms 58 and 59, and a space between the second link arm 59 and the movable support shaft 60 are lubricated, thus making it possible to ensure smooth valve operating action.

The crank member 61 is a single member which is supported at the engine body 11 for common use in a plurality of cylinders arranged in line, and is constructed into a crank shape having crank webs 61*a* and 61*a* disposed at opposite sides of the intake side rocker arm 31, journal parts 61*b* and 61*b* which perpendicularly link with outer surfaces of base end parts of both the crank webs 61*a* and 61*a* and are rotatably supported by the engine body 11, and a connecting part 61*c* which integrally connects both the crank webs 61*a* and 61*a* at a position where interference with the second link arm 59 is avoided for each cylinder. The movable support shaft 60 is connected to the crank member 61 so as to connect the both crank webs 61*a* and 61*a*.

The respective journal parts 61*b* . . . of the crank member 61 are rotatably supported between the upper holders 38 . . . connected to the cylinder head 14 of the engine body 11, and lower holders 77 . . . connected to the upper holder 38 from below. The lower holders 77 . . . are formed to be separate from the cylinder head 14 to be fastened to the upper holders 38 . . . , and recessed parts 78 . . . in which the lower holders 77 . . . are disposed are provided on the top face of the cylinder head 14.

Roller bearings 79 . . . are interposed between the upper and lower holders 38 . . . and 77 . . . , and the journal parts 61*b* . . . , and the roller bearings 79 . . . are capable of being split in halves to be interposed between the journal parts 61*b* . . . of the crank member 61, which has a plurality of webs 61*a*, 61*a* . . . and connecting parts 61*c* . . . and is for common use in a plurality of cylinders, and the upper and lower holders 38 . . . and 77 . . . .

Crank member support bosses 80 . . . which protrude to crank webs 61*a* . . . of the crank member 61 are formed in the upper and lower holders 38 . . . and 77 . . . to allow the journal part 61*b* to penetrate therethrough. Camshaft support boss parts 81 . . . through which the intake side camshaft 30 is penetrated through are formed in the upper holders 38 . . . and the caps 39 . . . joined to each other to collaborate to construct the intake side cam holders 41 . . . to protrude toward the intake side rocker arms 31 . . . , and ribs 82 . . . which connect the crank member support boss parts 80 . . . and the camshaft support boss parts 81 . . . are integrally provided in the upper holders 38 . . . .

Passages 83 . . . which guide oil to the roller bearings 79 . . . side are provided inside the ribs 82 . . . to communicate with the recessed parts 70 . . . of the top faces of the upper holders 38 . . . .

While the exhaust side valve operating system 33 is placed at the cylinder head 14 so that the swing support part of the exhaust side rocker arm 36 is disposed outside from the linking and connecting part of the exhaust side rocker arm 36 to the exhaust valves 21 . . . , the intake side valve operating system 28 is placed at the cylinder head 14 so that the intake side rocker shaft 57 and the movable support shafts 60 . . . are placed inside from the linking and connecting parts of the intake side rocker arms 31 . . . to the intake valves 20 . . . .

A plug cylinder 87, into which an ignition plug 86 mounted to the cylinder head 14 to face the combustion chamber 17 is inserted, is mounted to the cylinder head 14 between the intake side and exhaust side valve operating systems 28 and 33, and the plug cylinder 87 is disposed to tilt closer to the exhaust side valve operating system 33 toward the above.

Thus, the crank member 61 in the intake side valve operating system 28 is disposed between the intake valves 20 . . . and the plug cylinders 87 . . . so that the outer faces of the connecting parts 61*c* . . . are opposed to the plug cylinders 87 . . . , and relief grooves 88 . . . to avoid interference with the plug cylinders 87 . . . are formed on the outer faces of the connecting parts 61*c* . . . .

When the intake valves 20 . . . are in the valve closed state, the second connecting shaft 63, which connects the second link arm 59 to the intake side rocker arm 31, is on the same axis as the journal parts 61*b* . . . of the crank member 61, and when the crank member 61 swings around the axes of the journal parts 61*b* . . . , the movable support shaft 60 moves on the arc with the axis of the journal parts 61*b* . . . as the center.

In the crank member 61, a stopper pin 105, which is parallel with the axis of rotation of the crank member 61, namely, the axis of the journal part 61*b*, is provided to protrude at the crank web 61*a* at one end side, which is along the cylinder arrangement direction, for example, and a restraint hole 106 into which a tip end of the stopper pin 105 is inserted is formed into an arc shape with the axis of the journal part 61*b* as the center in the inner face of the side wall of the head cover 15 in the engine body 11, as shown in FIG. 7. Thus, the rotation range of the crank member 61 is restrained to the range in which the stopper pin 105 can move in the restraint hole 106. Namely, the stopper pin 105 parallel with the rotation axis of the crank member 61 is provided to protrude at the crank web 61*a* to restrain the rotation range of the crank member 61 by engagement with the engine body 11 side.

Figure 9:
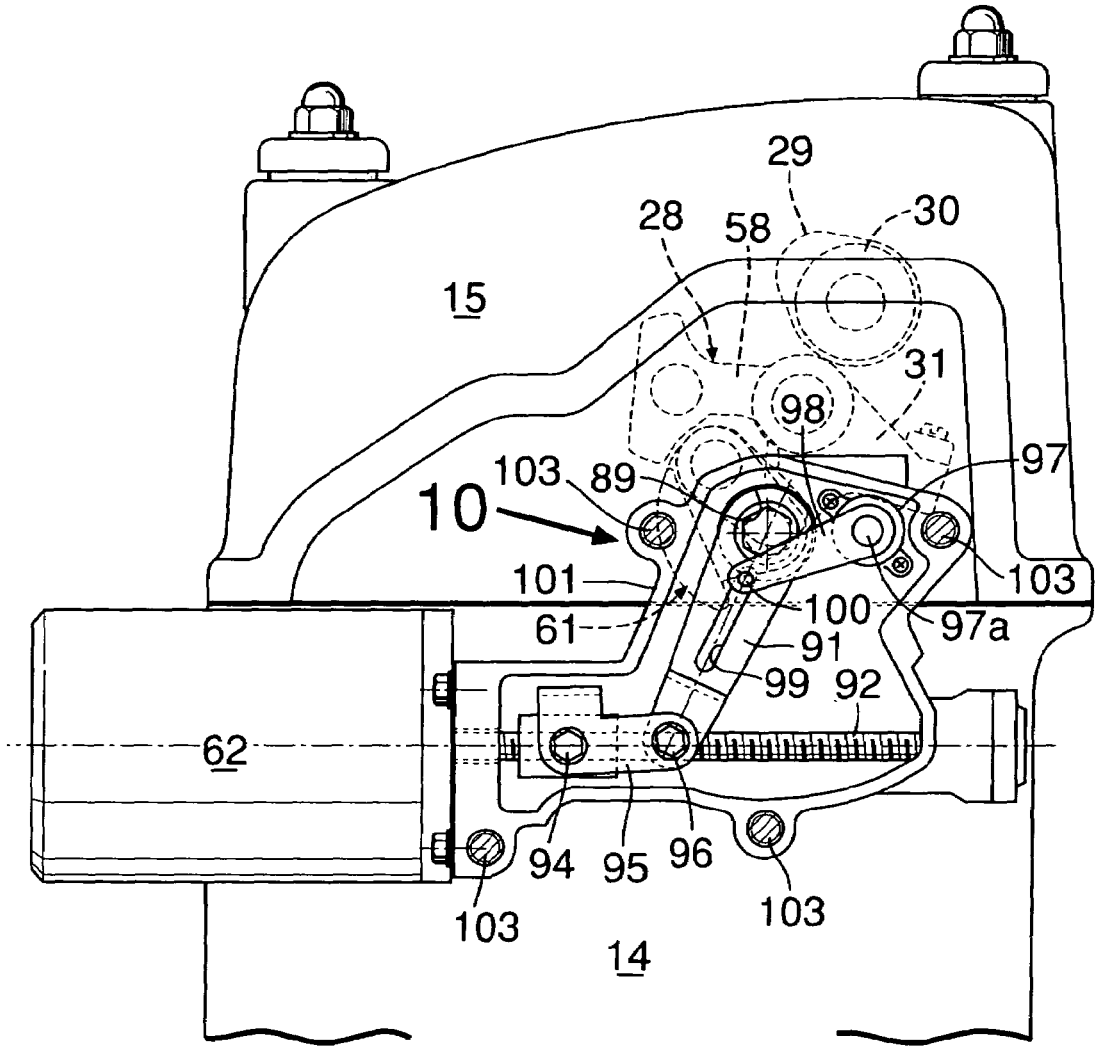
FIG. 9 is a view seen from the arrows of the line 9 to 9 in FIG. 2.
Figure 10:
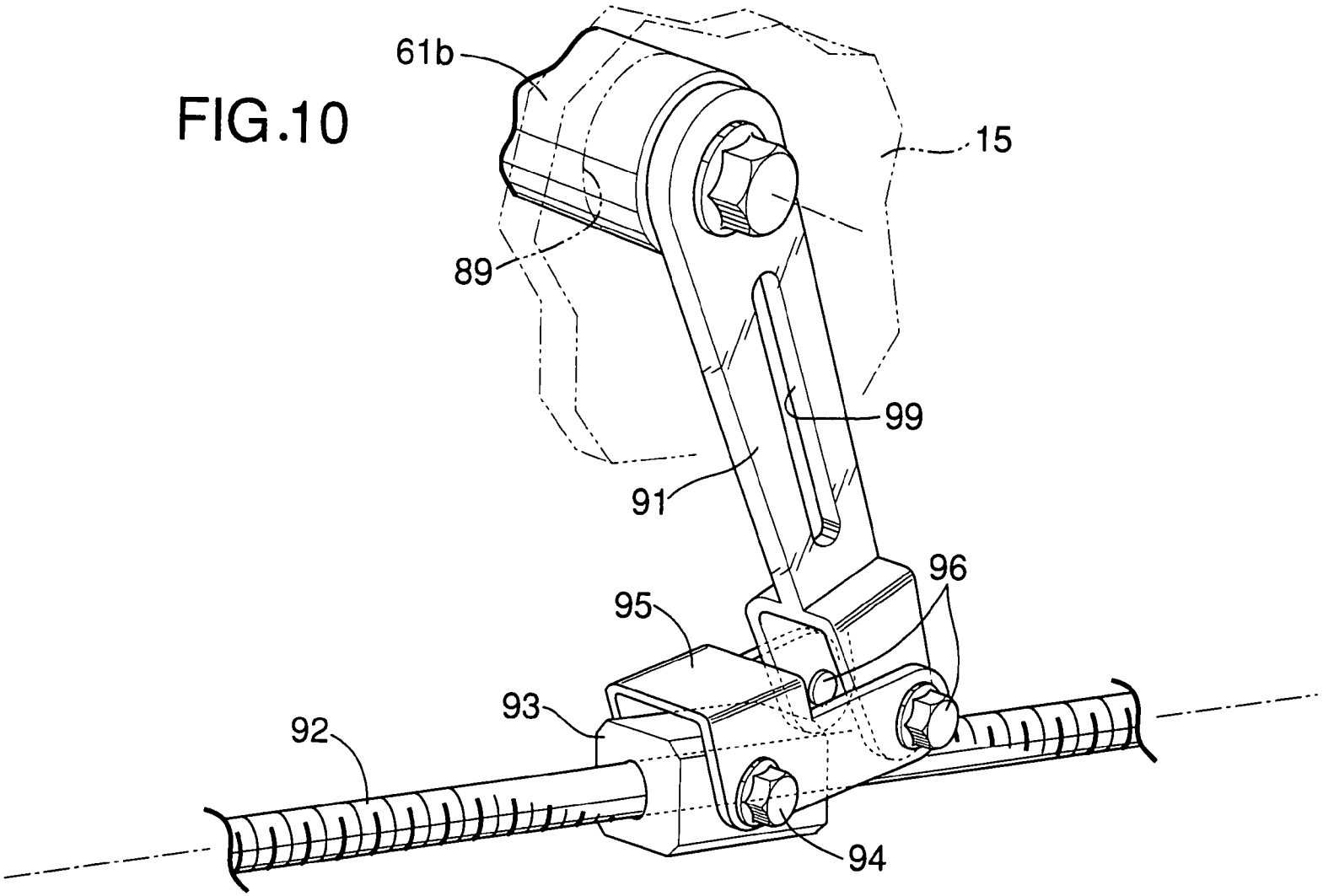
FIG. 10 is a perspective view seen in the direction of the arrow 10 in FIG. 9.

In FIG. 9 and FIG. 10, one of the journal parts 61*b* . . . which the crank member 61 includes protrudes from a support hole 89 provided at the head cover 15, a control arm 91 is fixed to a tip end of the journal part 61*b*, and the control arm 91 is driven by the actuator motor 62 mounted to an outer wall of the cylinder head 14. Namely, a nut member 93 is meshed with a screw shaft 92 which is rotated by the actuator motor 62, and one end of a connecting link 95 with the other end pivotally supported at the nut member 93 with a pin 94 is connected to the control arm 91 via pins 96 and 96. Accordingly, when the actuator motor 62 is operated, the nut member 93 moves along the rotating screw shaft 92, and the crank member 61 swings around the journal parts 61*b* . . . by the control arm 91 connected to the nut member 93 via the connecting link 95, whereby the movable support shaft 60 is displaced.

A rotational angle sensor 97 such as, for example, an encoder is provided at an outer wall face of the head cover 15, and one end of a sensor arm 98 is fixed to a tip end of a sensor shaft 97*a*. A guide groove 99 linearly extending along a longitudinal direction of the control arm 91 is formed in the control arm 91, and a connecting shaft 100 provided at the other end of the sensor arm 98 is slidably fitted in the guide groove 99.

The screw shaft 92, the nut member 93, the pin 94, the connecting link 95, the pins 96 and 96, the control arm 91, the rotational angle sensor 97, the sensor arm 98 and the connecting shaft 100 are housed in a case 101 which is mounted to side faces of the cylinder head 14 and the head cover 15 with bolts 102 . . . , and a cover 103 which covers an open end face of the case 101 is mounted to the case 101 with the screw members 104 . . . .

In the variable valve lift device 32, when the control arm 91 rotates in the counterclockwise direction from the position shown in FIG. 9 with the actuator motor 62, the crank member 61 connected to the control arm 91 also rotates in the counterclockwise direction, and the movable support shaft 60 lowers. When the roller 50 is pressed with the intake side valve operating cam 29 of the intake side camshaft 30 in this state, a quadric link connecting the intake side rocker shaft 57, the first connecting shaft 51, the second connecting shaft 63 and the movable support shaft 60 is deformed and the intake side rocker arm 31 swings downward. The tappet screws 49 and 49 press the stems 20*a* . . . of the intake valve 20, and the intake valves 20 . . . are opened with low lift.

When the control arm 91 rotates to the solid line position in FIG. 9 with the actuator motor 62, the crank member 61 connected to the control arm 91 is rotated in the clockwise direction, and the movable support shaft 60 rises. When the roller 50 is pressed with intake side valve operating cam 29 of the intake camshaft 30 in this state, the quadric link is deformed, the intake side rocker arm 31 swings downward, the tappet screws 49 and 49 press the stem 20*a* of the intake valves 20 . . . , and the intake valves 20 . . . open with high lift.

Next, explaining the operation of this embodiment, in the variable valve lift device 32 which continuously changes the valve opening lift amount of the intake valves 20 . . . , one end portions of the first and second link arms 58 and 59 are connected in parallel to the intake side rocker arm 31 having the valve connecting part 31*a* linked and connected to a pair of intake valves 20 . . . to be relatively rotatable, and the other end portion of the first link arm 58 is rotatably supported by the intake side rocker shaft 57 supported by the engine body 11, while the other end portion of the second link arm 59 is rotatably supported by the displaceable movable support shaft 60.

Accordingly, it is possible to change the amount of lift of the intake valves 20 . . . by continuously displacing the movable support shaft 60, and it is possible to control the intake amount by making the throttle valve unnecessary. In addition, the one end portions of the first and second link arms 58 and 59 are directly connected to the intake side rocker arm 31 to be rotatable, thus making it possible to reduce the space where both the link arms 58 and 59 are disposed to make the valve operating system compact, and the power from the intake side valve operating cam 29 is directly transmitted to the roller 50 of the intake side rocker arm 31, thus making it possible to ensure excellent follow-up ability to the intake side valve operating cam 29. The positions of the intake side rocker arm 31, the first and second link arms 58 and 59 in the direction along the axis of the intake side cam shaft 30 are disposed at substantially the same position, and therefore, the intake side valve operating system 28 in the direction along the axis of the intake side camshaft 31 can be made compact.

The one end portion of the first link arm 58 is rotatably connected to the intake side rocker arm 31 via the first connecting shaft 51, and the roller 50 is pivotally supported at the intake side rocker arm 31 via the first connecting shaft 51. Therefore, rotatable connection of the one end portion of the first link arm 58 to the intake side rocker arm 31, pivotal support of the roller 50 to the intake side rocker arm 31 are achieved by the common first connecting shaft 51, whereby the number of components is reduced and the intake side valve operating system 28 can be made more compact.

In the intake side valve operating system 28 including the variable link mechanism 32 of the intake side and exhaust side valve operating systems 28 and 33, the intake side rocker shaft 57 and the movable support shaft 60 are disposed inside from the linking and connecting part of the intake side rocker arm 31 to the intake valves 20 . . . , and the swing support part of the exhaust side rocker arm 36 included by the exhaust side valve operating system 33 is disposed outside from the linking and connecting part of the exhaust side rocker arm 36 and the exhaust valves 21 . . . . Therefore, even if an angle of nip a (see FIG. 1) of the intake valves 20 . . . and the exhaust valves 21 . . . is set to be small to obtain favorable combustion by making the combustion chamber 17 compact, mutual interference of the intake side and exhaust side valve operating systems 28 and 33 can be avoided while avoiding increase in size of the cylinder head 14.

The exhaust side valve operating system 33 includes the exhaust side cam shaft 35 having the exhaust side valve operating cam 34, and the exhaust side rocker arm 36 which is swingably supported at the engine body 11 via the exhaust side rocker shaft 43 to swing by following the exhaust side valve operating cam 34 and linked and connected to the exhaust valves 21 . . . , and the plug cylinder 68 disposed between the intake side and exhaust side valve operating systems 28 and 33 is mounted to the cylinder head 14 by being tilted to be closer to the exhaust side valve operating system 33 toward the above. Therefore, the plug cylinder 68 is disposed to avoid interference of the intake side and exhaust side valve operating systems 28 and 33, thus making it possible to contribute to making the entire head 14 more compact.

Incidentally, the crank member 61 included by the variable link mechanism 32 of the intake side valve operating system 28 is constructed in the crank shape by having the crank webs 61*a* and 61*a* sandwiching the second link arm 59 from opposite side, and the connecting part 61*c* which integrally joins both the crank webs 61*a* and 61*a* at the position where the interference with the second link arm 59 is avoided, and the movable support shaft 63 is connected to the crank member 61 to connect both the crank webs 61*a* and 61*a*. Accordingly, rigidity of the crank member 61 which is driven to make angular displacement can be increased, and even if the torque required for rotation of the crank member 61 is large, the torsion strength burden of the movable support shaft 63 can be made small. The movable support shaft 63 is made the separate body from the crank member 61, and the movable support shaft 63 is inserted by press-fitting or the like in the state in which the movable support shaft insertion parts of a pair of crank webs 61*a* and 61*a* and the second link arm 59 are aligned, thus facilitating assembly. In addition, the connecting part 61*c* of the crank member 61 does not interfere with the second link arm 59, and therefore, the crank member 61 and the second link arm 59 do not increase in size.

The stopper pin 105 parallel with the axis of rotation of the crank member 61 is provided to protrude at the crank web 61*a* to restrain the rotation range of the crank member 61 by the engagement with the engine body 11 side, and therefore, the structure to restrain the rotation range of the crank member 61 can be constructed to be compact. The crank member 61 is connected to the movable support shaft 60 allowing the movable support shaft 60 to perform angular displacement around the axis which is parallel with its axis and is supported at the engine body 11 at the opposite sides of the intake side rocker arm 31, and support rigidity of the crank member 61 is enhanced by supporting at the opposite sides, thus making it possible to precisely perform the variable lift amount control of the intake valves 20 . . . .

Since the single crank member 61 is supported at the engine body 11 to be common to a plurality of cylinders arranged in line, an increase in the number of components is avoided and the internal combustion engine E can be made compact.

The journal portions 61*b* . . . of the crank member 61 are rotatably supported between the upper holders 38 . . . joined to the cylinder head 14 of the engine body 11, and the lower holders 77 . . . joined to the upper holders 38 . . . from below. Assembly workability of the crank member 61 to the engine body 11 can be enhanced, and the lower holders 77 . . . which are separate bodies from the cylinder head 14 are fastened to the upper holders 38 . . . , therefore, making it possible to increase degree of freedom of the design of the cylinder head 14 in supporting the crank member 61.

Since the roller bearings 79 . . . , which can be split in halves, are interposed between the upper and lower holders 38 . . . and 77 . . . , and the journal parts 61*b* . . . , assembly workability of the crank member 61 can be enhanced while reducing the friction loss at the support part of the crank member 61.

The crank member support boss parts 80 . . . which protrude to the crank webs 61*a* . . . of the crank member 61 are formed at the upper and lower holders 38 . . . and 77 . . . joined to each other, and the journal parts 61*b* . . . penetrating through the crank member support boss parts 80 . . . are rotatably supported between the upper and lower holders 38 . . . and 77 . . . , therefore making it possible to further enhance the support rigidity of the crank member 61.

The cam shaft support boss parts 81 . . . which protrude toward the intake side rocker arm 31 are formed in the upper holders 38 . . . and the caps 39 . . . joined to the upper holders 38 . . . from above, and the intake side camshaft 30 penetrates through the camshaft support boss parts 81 . . . and rotatably supported between the upper holders 38 . . . and the caps 39 . . . . Therefore, the support rigidity of the intake side camshaft 30 can be enhanced while restraining the number of components for supporting the intake side camshaft 30 to the minimum.

Since the ribs 82 . . . connecting the crank member support boss parts 80 . . . and the camshaft support boss parts 81 . . . are provided to protrude at the upper holders 38 . . . , the support rigidity of the crank member 61 and the intake side camshaft 30 can be further enhanced.

Incidentally, the crank member 61 is disposed between the intake valves 20 . . . and the plug cylinder 87 provided at the cylinder head 14 so that the outer face of the connecting part 61*c* is opposed to the plug cylinder 87, and the relief groove 88 for avoiding the interference with the plug cylinder 87 is formed on the outer face of the connecting part 61*c*, therefore making it possible to dispose the plug cylinder 87 closer to the intake side valve operating system 28, and make the internal combustion engine E compact.

In the intake side rocker arm 31 of the intake side valve operating system 28, the lightening parts 53, 54 and 54 which alternate each other are formed on the opposite faces from each other of the valve connecting part 61*a*, and therefore, it is possible to reduce the weight of the intake side rocker arm 31.

The lightening parts 53, 54 and 54 are also formed at the time of die forming of the intake side rocker arm 31, and since the draft angles of the lightening parts 53 and 54; and 53 and 54 adjacent to each other are in the opposite directions from each other, the inner faces of the lightening parts 53 and 54; and 53 and 54 adjacent to each other tilt in the same direction. Accordingly, the thickness of the wall parts 31*d* and 31*d* which are formed between the lightening parts 53 and 54; and 53 and 54 adjacent to each other at the intake side rocker arm 31 is substantially uniform, and rigidity of the intake side rocker arm 31 can be kept by the wall parts 31*d* and 31*d* of the substantially uniform thickness.

Since the intake side valve operating system 28 includes the variable valve lift device 32 which makes the amount of lift of the intake valves 20 . . . continuously variable, it is made possible to reduce the weight of the intake side valve operating system 28 by reducing the weight of the intake side rocker arm 31 and the limit rotational speed can be increased, even in the intake side valve operating system 28 having the variable valve lift device 32 which tends to cause the increase in weight of the intake side valve operating system 28 with a comparatively large number of components.

Although embodiments of the present invention are described above, the present invention is not limited to the above-described embodiments, and can be modified in a variety of ways without departing from the scope and the spirit of the present invention described in the claims.

What is claimed is:

1. A variable valve lift device of an internal combustion engine, comprising:

a rocker arm (31) linked and connected to an engine valve (20) having a cam abutment part (50) abutting to a valve operating cam (29);

a first link arm (58) with one end portion rotatably connected to the rocker arm (31) and the other end portion rotatably supported at a fixed position of an engine body (11) via a fixed support shaft (57);

a second link arm (59) with one end portion rotatably connected to the rocker arm (31);

a movable support shaft (60) which rotatably supports the other end portion of the second link arm (59);

a crank member (61) connected to the movable support shaft (60) allowing the movable support shalt (60) to perform angular displacement around an axis parallel with its axis and rotatably supported at the engine body (11); and drive means (62) connected to the crank member (61) to make the movable support shaft (60) perform angular displacement, wherein the crank member (61) is formed in a crank shape, having crank webs (61*a*) sandwiching the second link arm (59) from opposite sides, and a connecting part (61*c*) integrally joining both the crank webs (61*a*) at a position where interference with the second link arm (59) is avoided, and the movable support shaft (60) is connected to the crank member (61) to connect both the crank webs (61*a*).

2. The variable valve lift device of an internal combustion engine according to claim 1, wherein a stopper pin (105) parallel with an axis of rotation of the crank member (61) is provided to protrude at the crank web (61*a*) to restrain a rotation range of the crank member (61) by engagement with the engine body (11) side.

3. The variable valve lift device of an internal combustion engine according to claim 1 or 2, wherein the crank member (61) is supported at the engine body (11) at opposite sides of the rocker arm (31).

4. The variable valve lift device of an internal combustion engine according to claim 1, wherein the crank member (61) is single crank member common to a plurality of cylinders arranged in line and is supported at the engine body (11).

5. The variable valve lift device of an internal combustion engine according to claim 1, wherein the crank member (61) has a journal part (61*b*) perpendicularly connecting to an outer face of the crank web (61*a*), and the journal part (61*b*) is rotatably supported between an upper holder (38) forming a part oh cam bolder (41) rotatably supporting a camshaft (30) provided with the valve operating cam (29) and joined to the cylinder head (14) of the engine body (11), and a lower holder (77) joined to the upper holder (38) from below.

6. The variable valve lift device of an internal combustion engine according to claim 5, wherein the lower holder (77) which is a separate body from the cylinder head (14) is fastened to the upper holder (38).

7. The variable valve lift device of an internal combustion engine according to claim 5 or 6, wherein a roller bearing (79) capable of being split into halves is interposed between the upper and lower holders (38, 77) and the journal part (61*b*).

8. The variable valve lift device of an internal combustion engine according to claim 5, wherein a crank member support boss part (80) protruded to the crank web (61*a*) side is formed in the upper and lower holders (38, 77) joined to each other, and the journal part (61*b*) penetrating through the crank member support boss part (80) is rotatably supported between the upper and lower holders (38, 77).

9. The variable valve lift device of an internal combustion engine according to claim 8, wherein a camshaft support boss part (81) protruded to the rocker arm (31) side is formed in the upper holder (38) and a cap (39) joined to the upper holder (38) from above, and the camshaft (30) having the valve operating cam (29) penetrates through the camshaft sir port boss part (81) and is rotatably supported between the upper holder (38) and the cap (39).

10. The variable valve lift device according to claim 9, wherein a rib (82) connecting the crank member support boss part (80) and the camshaft support boss part (81) is provided to protrude at the upper holder (38).

11. The variable valve lift device according to claim 1, wherein the crank member (61) is disposed between the engine valve (20) and a plug cylinder (87) provided at a cylinder head (14) so that an outer face of the connecting part (61*c*) is opposed to the plug cylinder (87), and a relief groove (88) for avoiding interference with the plug cylinder (87) is formed on the outer face of the connecting part (61*c*).

* * * * *